US010258136B2

(12) United States Patent
Fiorello

(10) Patent No.: US 10,258,136 B2
(45) Date of Patent: Apr. 16, 2019

(54) SWIVEL-LOCK QUICK RELEASE

(71) Applicant: Albert Fiorello, Greenwood Village, CO (US)

(72) Inventor: Albert Fiorello, Greenwood Village, CO (US)

( * ) Notice: Subject to any disclaimer, the term of this patent is extended or adjusted under 35 U.S.C. 154(b) by 0 days.

(21) Appl. No.: 15/869,876

(22) Filed: Jan. 12, 2018

(65) Prior Publication Data

US 2018/0199698 A1 Jul. 19, 2018

Related U.S. Application Data

(60) Provisional application No. 62/446,190, filed on Jan. 13, 2017.

(51) Int. Cl.

| | |
|---|---|
| ***A45F 5/00*** | (2006.01) |
| ***A45F 5/02*** | (2006.01) |
| ***A44B 99/00*** | (2010.01) |

(52) U.S. Cl.

CPC ..... *A45F 5/00* (2013.01); *A44B 99/005* (2013.01); *A45F 5/021* (2013.01); *A44D 2200/10* (2013.01); *A45F 2005/006* (2013.01); *A45F 2005/026* (2013.01); *A45F 2200/0533* (2013.01); *A45F 2200/0575* (2013.01); *Y10S 24/60* (2013.01); *Y10T 24/45262* (2015.01)

(58) Field of Classification Search

CPC ..... A45F 5/00; A45F 5/02; A45F 2005/025; A45F 2200/0575; A45F 2200/0516; Y10S 24/60; Y10T 24/45262

USPC ..... 224/197, 198, 199, 200

See application file for complete search history.

(56) References Cited

U.S. PATENT DOCUMENTS

| | | | | |
|---|---|---|---|---|
| 3,080,634 A * | 3/1963 | Lindblad | B60R 22/18 | 24/579.11 |
| 4,419,794 A * | 12/1983 | Horton, Jr. | A45F 5/02 | 224/197 |
| 5,054,170 A * | 10/1991 | Otrusina | A45F 5/02 | 224/197 |
| 5,604,958 A * | 2/1997 | Anscher | A45C 7/0086 | 224/197 |
| 5,799,847 A * | 9/1998 | Sandor | A45F 5/02 | 224/197 |
| 5,839,173 A * | 11/1998 | Otrusina | A45F 5/02 | 24/595.1 |
| 6,038,742 A * | 3/2000 | Patterson | A45F 5/02 | 24/3.11 |
| 6,059,156 A * | 5/2000 | Lehtinen | A45F 5/02 | 224/197 |
| 6,283,345 B1 * | 9/2001 | Butschat | A45F 5/02 | 224/148.4 |
| 7,093,742 B2 * | 8/2006 | Steven, III | A45F 5/02 | 224/197 |

(Continued)

*Primary Examiner* — Justin M Larson

(74) *Attorney, Agent, or Firm* — Leyendecker & Lemire, LLC

(57) ABSTRACT

A swivel-lock quick release is described. Embodiments of the swivel-lock quick release can include, but is not limited to, a male member adapted to mate with a female member wherein the male member can be disengaged by lifting and then rotating the male member while continuously lifting the male member. The male member can include a slot adapted to interface with a protrusion from the female member. The male member and the female member can each include an attachment mechanism to couple to various objects and/or tools.

19 Claims, 12 Drawing Sheets

(56) References Cited

U.S. PATENT DOCUMENTS

| | | | | |
|---|---|---|---|---|
| 7,819,370 | B2 * | 10/2010 | Ho | F16B 45/00 224/197 |
| 8,075,202 | B1 * | 12/2011 | Chamberlayne | G03B 17/561 224/197 |
| 8,141,210 | B2 * | 3/2012 | Colorado | A45F 5/02 224/197 |
| 9,854,900 | B2 * | 1/2018 | Donnelly | A45F 5/00 |
| 2018/0199698 | A1 * | 7/2018 | Fiorello | A45F 5/00 |

* cited by examiner

SWIVEL-LOCK QUICK RELEASE

CROSS-REFERENCE TO RELATED APPLICATION

This application claims the benefit of U.S. Provisional Application No. 62/446,190, filed Jan. 13, 2017.

BACKGROUND

Currently available means for securing an object to a user include a variety of different holsters, pouches, quick releases, bags, Velcro, etc. For heavier objects, for instance various tools or cameras, most means include a mechanical locking mechanism to safely secure the object to the user. However, when implementing a mechanical locking mechanism, the user will more often than not need to use both hands to remove the object from the locking mechanism.

Workers, contractors, and construction workers often climb and work directly from a ladder or scaffolding. In either case, drills and other tools can be dropped when performing work with the tool falling to the ground and possibly injuring someone or breaking the tool. Not only is there a risk that the drill can fall from the ladder or scaffolding and be ruined upon impact, but there is danger that it can injure contractors or other personnel that happen to be located below the ladder or scaffolding. Further, most currently available means for securing the tool to the user requires a locking mechanism needing two hands to free the tool. Said workers, while working on the ground, need a secure means to hold tools while working while still making the tools easily available.

As such, there is a need for a locking mechanism that can be easily disengaged with one hand by a user grasping the object to be removed and can be implemented in a variety of different situations.

DETAILED DESCRIPTION

Figure 1:
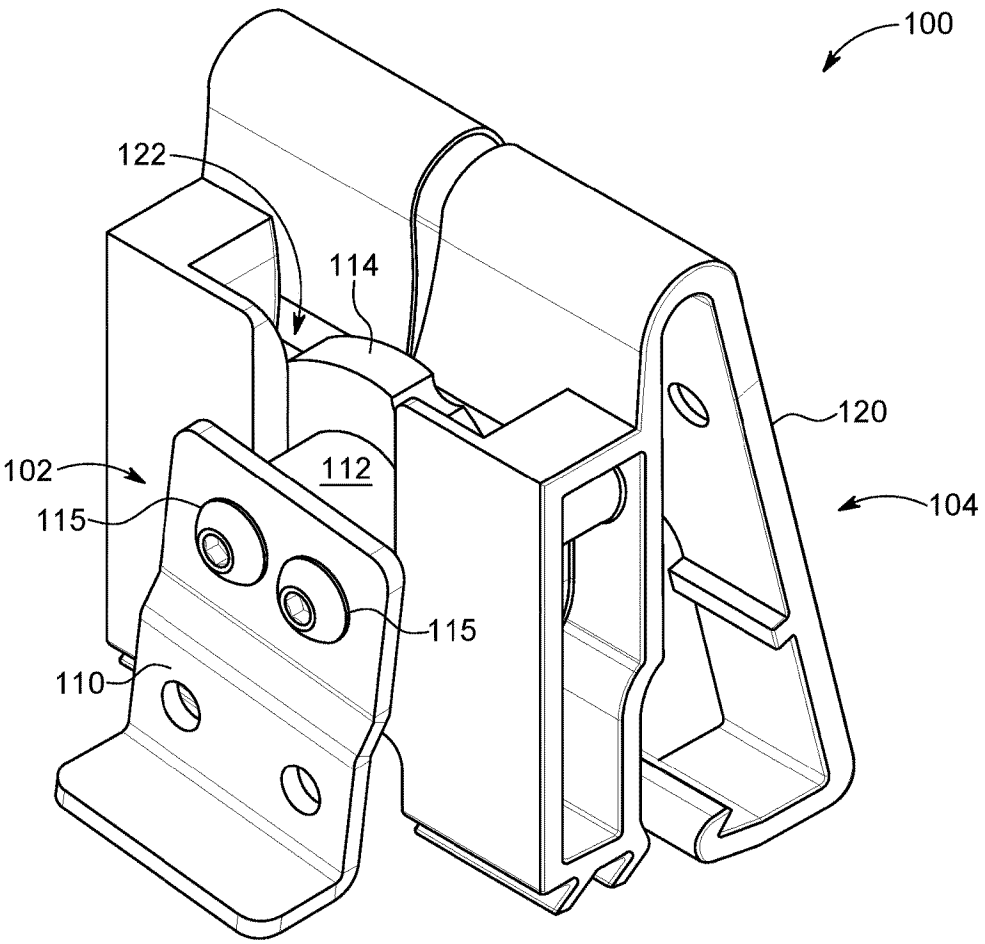
FIG. 1 is a perspective view of a swivel-lock quick release according to one embodiment of the present invention.

Embodiments of the present invention include a swivel-lock quick release adapted to be used with a variety of different objects. The swivel-lock quick release can be implemented to couple an object to a person or another object. Typically, the swivel-lock quick release can include, but is not limited to, a male member and a female member configured to mate with one another. Typically, the male member can be coupled to an object or tool and the female member can be coupled to an object in a relatively fixed location. For instance, the female member can be implemented to couple to a belt, a holster, a bag, a ladder, a harness, etc. For example, the belt can be fixed in a location proximate a wearer's waist.

In one embodiment, the male member can include an attachment mechanism, a protrusion extending from the attachment mechanism, and an engagement member located on a distal end of the protrusion. The attachment mechanism can be implemented to couple the male member to an object. Of note, the attachment mechanism can be configured to couple to various objects. For instance, the attachment mechanism may include a plate and a fastener for securing the male member to a drill. The engagement member can include a cylinder (or disc) located on a distal end of the protrusion and having a perimeter larger than the protrusion. A face of the cylinder can include a slot (or channel) formed therein. The slot can include a guide section and a locking section.

In one embodiment, the female member can include a slot (or channel) for receiving the cylinder of the male member, a protrusion located in the slot, and an attachment mechanism. The attachment mechanism of the female member can be based on the object the male member is coupled to. For instance, where the male member is coupled to a drill, the attachment mechanism of the female member may be configured to secure to a belt worn by a user. The protrusion located in the slot can be implemented to pass through the slot of the male member.

In a typical implementation, the male member can be coupled to an object a user may need to use intermittently. The user may then determine which type of female member to use based on the object being coupled proximate the user. Once the male member is coupled to the object and the female member is coupled to an intended location, the male member can be inserted into the female member. As can be appreciated, when the male member is inserted into the female member, the object can be coupled proximate the intended location. For instance, if the female member is coupled to a belt of user, the object can be located proximate the belt of the user when the male member is inserted into the female member.

One embodiment of the present invention includes a swivel-lock quick release system designed to hold a battery operated electric driver proximate a chest of an ice climber for use in conjunction with an ice climbing system described in the incorporated documents. The swivel-lock quick release system can securely lock the driver in place, typically positioned on a climber's chest by way of a harness. The system can further permit the climber to remove the driver from the harness with a single hand by way of a slight upward motion followed by a slight rotation. Upon insertion of the male member, which may be secured to the driver, into the channel of a female member, which may be secured to the harness, gravity can pull the male member downward (or by manual manipulation of the user) and causes the male member to rotate thereby locking the driver in place. As can be appreciated, depending on design of the tool or object being used with the swivel-lock quick release, the user may need to manually manipulate the tool to rotate and lock. When locked, the male member cannot be easily and unintentionally separated from the female member.

Of note, the swivel-lock quick release has numerous additional uses apart from ice climbing as would be obvious to one of ordinary skill given the benefit of this disclosure.

In another embodiment, the swivel-lock quick release can be implemented in construction. For instance, the swivel-lock quick release can be especially used in construction practices where a user is elevated far above the ground or while working on the ground. A tool, such as a drill, can be secured with the swivel-lock quick release to a user's harness or belt and easily removed with a single hand, freeing the other hand to be used to hold a fastener, hold a component to be secured to the associated structure in the other hand, or hold the rung or side of a ladder or scaffolding. Unlike many drill holsters, a drill bit, screw bit and/or socket of any necessary size and configuration can remain attached to the driver/drill when the device is secured in the swivel-lock quick release.

As can be appreciated, the swivel-lock quick release can also be adapted to secure binoculars, a camera, or even lenses to a chest harness for quick and easy access, while at the same time securely fastening the devices to the harness when they are not in use. Unlike prior art solutions which often require two hands to release the secured device, embodiments of the current system permit release with only a single hand.

In one embodiment, an operative section of the male member can comprise a cylindrical post (or protrusion) that extends outwardly of a mounting section (or from the implement when integrally formed therewith). The cylinder can terminate at a distal end comprising a radial outwardly extending circular flange. A specifically shaped slot (vaguely resembling a tree trunk and substantially vertically orientated and generally parallel two branches) can be provided in an outwardly facing face of the circular flange. The circular flange can be adapted to be received in a channel of the female member and the tree-shaped slot (tree slot) can be adapted to receive a pin (or protrusion) of the female member therein.

An operative section of the female member can comprise a channel adapted to receive the circular flange of the male member therein from a top surface of the female member. A front face of the female member can include a substantially "U" shaped slot configured to cradle the cylindrical post of the male member when the circular flange is received in the channel. A pin (or protrusion) can protrude into the channel from a backside of the channel. The pin can be centered laterally within the channel but can be located longitudinally closer to a top of the channel than a bottom of the channel. The pin can be comprised of a rigid and wear resistant material. For instance, the pin may be manufactured from steel, steel alloys, aluminum, and/or other metals and metal alloys. In some embodiments, the pin may be manufactured from a rigid polymeric material.

The top surface of the female member may also optionally include one or more grooves to visually indicate to a user whether the male member is in a locked position and the proper position to permit removal or insertion of the male member into or out of the female member. These groove(s) can correspond to a singular groove on the circular flange. In one example, the circular flange groove and the female member groove can be painted a day-glow orange. Operatively, when the circular flange groove is aligned with left or right grooves of the female member, the swivel-lock quick release can be in a locked position. When the circular flange groove is aligned with the center groove of the female member, the swivel-lock quick release can be in an unlocked position and the male member can be freely moved in and out of the female member.

Described hereinafter is one example of an operation of the swivel-lock quick release. Concerning insertion of the male member, the circular flange can be placed in the channel of the female member with the bottom end (or trunk end) of the tree slot positioned above the pin. To begin, the circular flange groove and the center groove of the female member can be aligned so that the male member may be engaged to the female member. Next, after the grooves are aligned, the circular flange can be lowered until the pin impacts the top end of the trunk of the tree slot whereat the branches extend outwardly from the left and right sides thereof. After which, the user need only release the object, thus allowing gravity to act thereon and rotate the circular flange to the left or right depending on the location of a center of gravity of the object coupled to the male member. Of note, in some instances the user may need to manually manipulate the object to rotate the circular flange. As the circular flange rotates, the pin can move across the respective branch of the tree slot until the pin is received in the substantially vertical section of the branch and bottoms out against the top edge of the branch. Of note, the foregoing assumes that the center of gravity of the object and male member combination is not perfectly vertically aligned with the pin, which may be a reasonable assumption for almost all uses of the swivel-lock quick release. Even when the center of gravity may so be aligned, a slight push to one side by the user can cause this alignment to be lost and permit gravity to pull the circular flange into the locked position.

When in the locked position, the trunk of the tree slot and vertical sections of the branches are not vertical but canted off of vertical at an acute angle. As can be appreciated, this can effectively prevent the pin, which has a diameter slightly smaller than the width of the slot at the branch, from rotating more than a few degrees left or right. Further, if pulled straight upwardly, the pin impacts the bottom face of the tree branch after a small movement and prevents removal of the circular flange.

To unlock the swivel-lock quick release, a user needs to perform two distinct movements in order. First, the male member must be pulled substantially vertically upwardly while canted to one side (e.g., the circular flange groove is aligned with either the left or right grooves of the female member). While the male member is in a slightly raised position, the user can then rotate the male member toward the center groove of the female member to expose the pin to the trunk. Only once the pin is located in the trunk can the male member can be removed without the pin preventing removal.

When locking or unlocking the male member from the female member, the male member can typically be rotated approximately 10-35 degrees. Several different factors may determine how much rotation is needed to lock and unlock the male member. For instance, a size, weight, and shape of a particular object may determine how much rotation is needed.

Several important features are evident in the tree slot that effect optimal operation of the swivel-lock quick release. The top side of the trunk of the tree slot can be typically slightly arcuate. The arcuate shape can create a slight lip at the intersection with a respective branch. The interaction of this lip and the pin assist in providing a more secure locked position than if the top side of the trunk were flat. Also, the branches of the tree slot can terminate in radiused ends. Of note, an effective radius of a bottom end of the slot can be approximately greater than a radius of a top end of the branch slots. More particularly, the radius of the top end can be essentially ½ the width of the slot; whereas, the radius of the bottom end can be greater than ½ the width of the slot of the branch. As can be appreciated, this can permit easier rotation of the pin once the male member is lifted, helping to guide the pin into the trunk member of the slot. Finally, the trunk member of the tree slot can be tapered. The tapering can primarily to help in the insertion of the male member into the channel of the female member, wherein the user has some leeway in initially aligning the male and female members. The taper of the trunk does not affect an operation of the locking section. In variations and other embodiments, the exact dimensions and nature of the various features can vary somewhat and still provide an effective locking action.

Although the swivel-lock quick release has been described in relation to the male member being attached to the tool or implement and the female member being attached to a harness or belt, it is to be appreciated that this can be reversed in variations. Further, a variation of the swivel-lock quick release is contemplated having only a single branch in the tree slot instead of two, permitting the swivel to lock only when rotated in a particular direction instead of both clockwise and counterclockwise.

In one embodiment, the swivel-lock quick release can be implemented in combination with a belt or a harness and an implement or tool. For instance, the tool can be a driver.

In another embodiment, the swivel-lock quick release can be implemented with an ice screw system as described in the incorporated references.

This application incorporates the following documents in their entirety by reference herein: U.S. Pat. Nos. 9,217,288; 9,303,456; and U.S. patent application Ser. No. 15/052,289. All of the referenced applications share a common inventor with the present invention and describe embodiments of an ice screw climbing system using an electric driver to set the ice screws as well as certain components of the climbing system.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "stadium," as used in this specification and appended claims, refers to a geometric shape constructed of a rectangle with semicircles at a pair of opposite sides.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Swivel-Lock Quick Release

Referring to FIG. 1, a detailed diagram of an embodiment 100 of a swivel-lock quick release is illustrated. Typically, the swivel-lock quick release 100 can be implemented to couple one object to another object, substrate, person, etc. For instance, the swivel-lock quick release may couple a drill to a work belt of a user.

As shown in FIG. 1, the swivel-lock quick release 100 can include a male member 102 and a female member 104. Typically, the male member 102 can be coupled to an object that can be readily removed from the female member and be implemented by a user. The female member 104 can typically be coupled to an object in a relatively fixed location. For instance, the female member 104 may be coupled to a tool belt of a construction worker. Of note, the tool belt can be fixed about a wearer's waist. In one example, the male member 102 can be coupled to a camera and the female member 104 can be coupled to a shoulder strap of a messenger bag allowing the camera to be readily removed to take a picture by a user.

The male member 102 can typically include, but is not limited to, an attachment (or mounting) mechanism 110, a protrusion 112, and an engagement member 114. Depending on an implementation, each of the components of the male member 102 can be integrally formed, partially integrally formed, or each independently manufactured. For instance, as shown in FIG. 1, the attachment mechanism 110 can be removably coupled to the protrusion 112. In one embodiment, the male member 102 can be integrally formed with a tool or object where the protrusion 112 extends out from the tool and includes the engagement member 114. In such an embodiment, the attachment mechanism 110 would be integrally formed as part of the tool.

The attachment mechanism 110 can be implemented to couple the male member 102 to an object. Of note, the attachment mechanism 110 can be one of several different designs, configurations, etc. depending on the object. As shown in FIG. 1, the attachment mechanism 110 can be coupled to the protrusion 112 via a pair of fasteners 115. As can be appreciated, in some embodiments the attachment mechanism 110 can be removably coupled to the protrusion 112 to allow various attachment mechanisms to be interchangeably coupled to the protrusion 112. The attachment mechanism 110 shown in FIG. 1 can be implemented to couple the male member 102 to a drill, as shown generally in FIGS. 4A-5B.

The protrusion 112 can be implemented to provide a means for the attachment mechanism 110 to be coupled to an object as the engagement member 114 is inserted into a channel of the female member 104. As shown generally in FIGS. 1-3, the protrusion 112 can be defined by a cylindrical shape having a diameter smaller than the diameter of the engagement member 114.

In one embodiment, as generally shown in the figures, the engagement member 114 can be defined by a disc like shape having a thickness and diameter.

The female member 104 can include, but is not limited to, an attachment (or mounting) mechanism 120, a channel 122, and a protrusion 124 (not shown in FIG. 1). The attachment mechanism 120 can be implemented to couple the female member 104 to an object. For instance, as shown in FIG. 1, the attachment mechanism 120 can be implemented to couple the female member 104 to a belt. Typically, the female member 104 can be configured to attach to a relatively fixed location object where the tool attached to the male member 102 can rest.

Figure 2A:
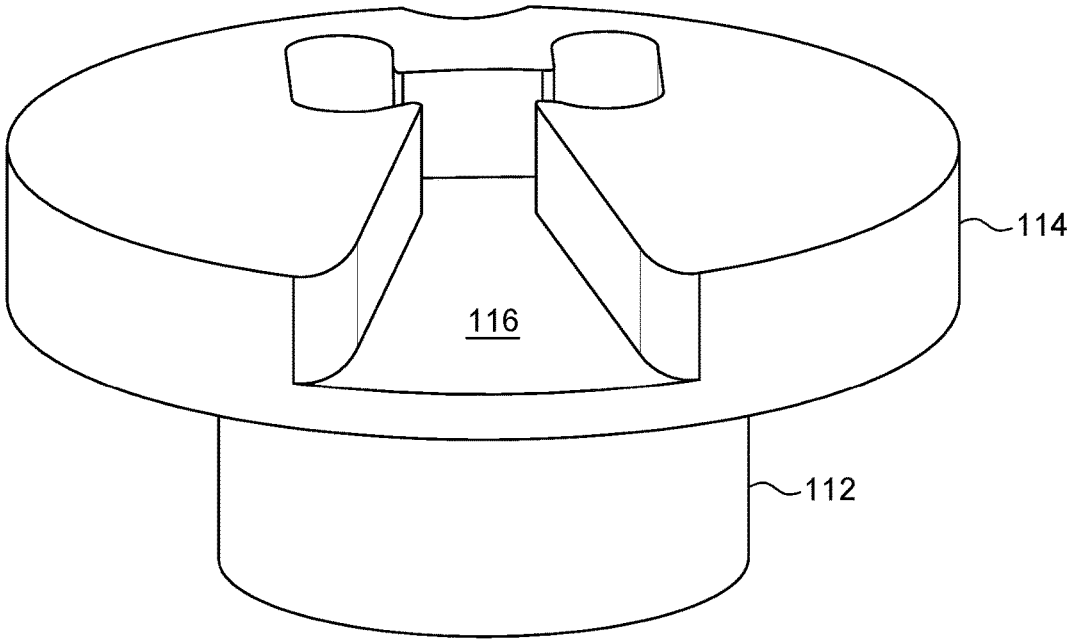
FIG. 2A is a side perspective view of a male member of a swivel-lock quick release according to one embodiment of the present invention.
Figure 2B:
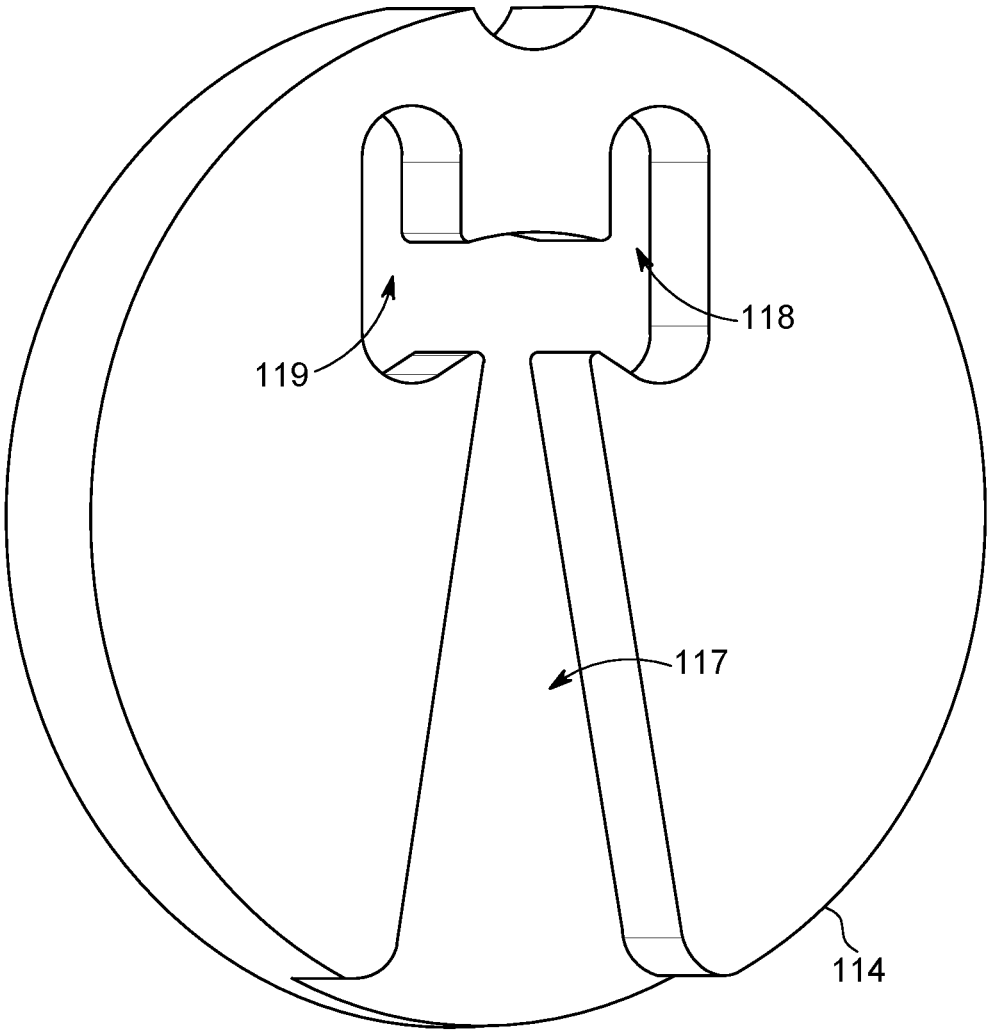
FIG. 2B is a top perspective view of a male member of a swivel-lock quick release according to one embodiment of the present invention.
Figure 2C:
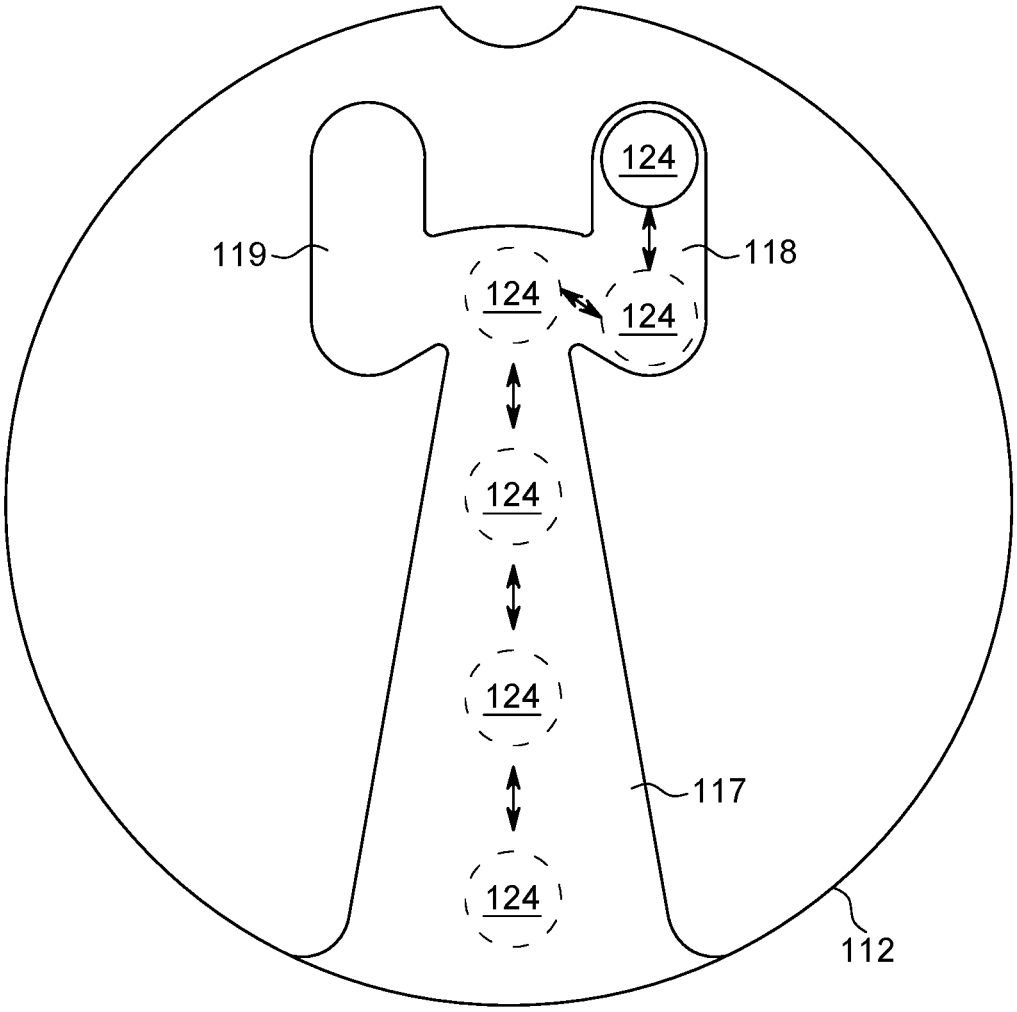
FIG. 2C is a top view of a male member of a swivel-lock quick release according to one embodiment of the present invention.

Referring to FIGS. 2A-2C, a plurality of different views of the male member 102 are illustrated. Of note, the attachment mechanism 110 is not shown in FIGS. 2A-2C.

Referring to FIG. 2A, a side perspective view of the male member 102 is illustrated. As shown, the male member 102 can include a slot (or channel) 116 extending from a bottom edge of the engagement member 114 to proximate an upper edge of the engagement member 114.

Referring to FIG. 2B, a top perspective view of the male member 102 is illustrated. Typically, the channel 116 can include at least a first section 117 and a second section 118. In some embodiments, the channel 116 can further include a third section 119 that may mirror the second section 118. Typically, the first section 117 can be implemented as a guide section and the second section 118 can be implemented as a locking section. The guide section 117 can be tapered down towards the locking section 118 and include an open mouth designed to receive and guide the protrusion 124 of the female member 104 to the locking section 118. Of note, by including the third section 119 that mirrors the second section 118, the swivel-lock quick release may be implemented by either a right handed or left handed person. Further, depending on a preference of the user, the user may rotate the male member 102 either clockwise or counterclockwise to remove the male member 102 when two locking sections are included. As an example, a user could attach the female member 104 to either a right side or a left side of a belt based on personal preference. With two locking sections, the user could then rotate the male member 102 either clockwise or counterclockwise based on personal preference allowing a left hand or right handed person to easily implement the swivel-lock quick release 100.

As shown, the locking section 118 can be defined by a substantially stadium shape oriented substantially vertically with an opening allowing the protrusion 124 of the female member 104 to enter into the locking section 118. Generally, the locking section 118 can be offset from the guide section 117. Of note, the opening into the locking section 118 can typically be located above a curved portion of a bottom of the stadium such that the protrusion 124 may rest in the bottom of the locking section 118 and not exit the locking section. For instance, if the female member 104 were to be turned upside down with the male member 102 inserted, the protrusion 124 of the female member 104 may rest on the bottom of the locking section and not allow the male member 102 to be removed.

Referring to FIG. 2C, a top view of the male member 102 is illustrated. FIG. 2C includes one example movement of the protrusion 124 of the female member 104 moving through the channel 116 of the male member 102. As shown, the protrusion 124 can enter the channel 116 at the bottom of the engagement member 114 and move up through the guide section 117 to the locking section 118. In a typical implementation, gravity can push the male member 102 down wherein the protrusion 124 can pass through the opening of the locking section 118 and move to the top of the locking section 118. Of note, the protrusion 124 and locking section 118 can typically be sized such that the protrusion 124 may move through the locking section 118 with minimal lateral movement.

To remove the male member 102 from the female member 104, the male member 102 can be moved upwards, thus moving the protrusion towards the bottom of the locking section 118. Once the protrusion 124 is located proximate a bottom of the locking section 118, the male member 102 can be rotated to move the protrusion 124 back to the guide section 117 and then lifted to remove the male member 102 from the channel 122 of the female member 104.

Referring to FIGS. 3A-3E, a plurality of different views of one embodiment of the female member 104 are illustrated. As shown generally in FIGS. 3A-3E, a female member 104 including an attachment mechanism 120 configured to couple to a belt is illustrated. It is to be appreciated that the attachment mechanism 120 configured to attach to a belt is one example and not meant to be limiting.

Figure 3A:
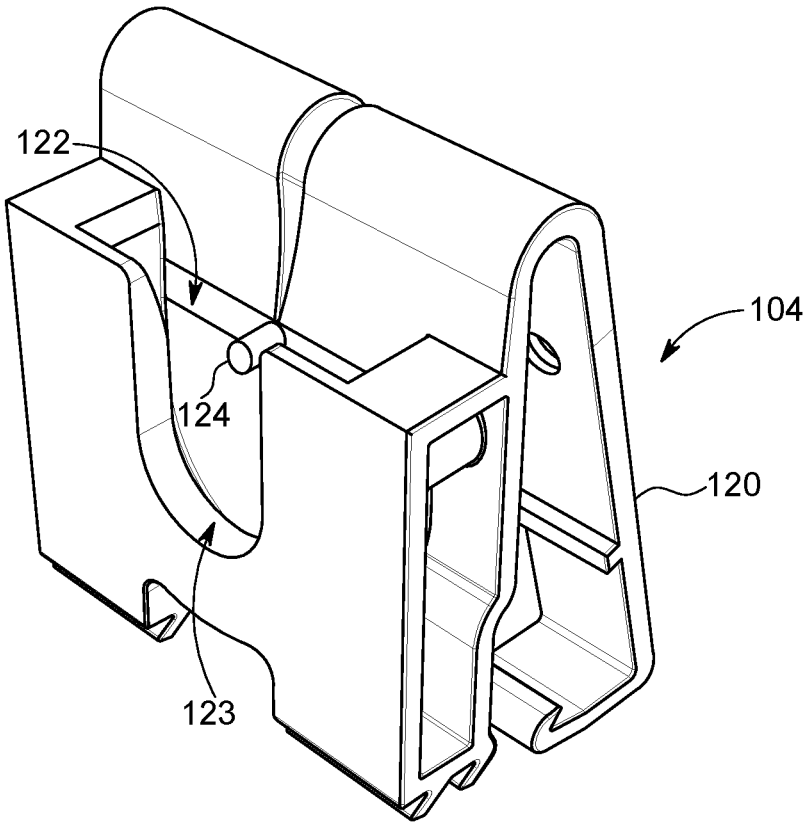
FIG. 3A is a perspective view of a female member of a swivel-lock quick release according to one embodiment of the present invention.

Referring to FIG. 3A, a front perspective view of the female member 104 is illustrated. The protrusion 124 can extend from a back of the channel 122 to proximate a middle of the channel 122. As shown in FIG. 3A, a front of the female member 104 can include a slot 123 to allow the protrusion 112 of the male member to slide down (or up) while the engagement member 114 slides down (or up) in the channel 122. Of note the slot 123 can be sized such that the engagement member 114 can be wider than the slot so that the engagement member 114 can not exit through the slot 123.

Figure 3B:
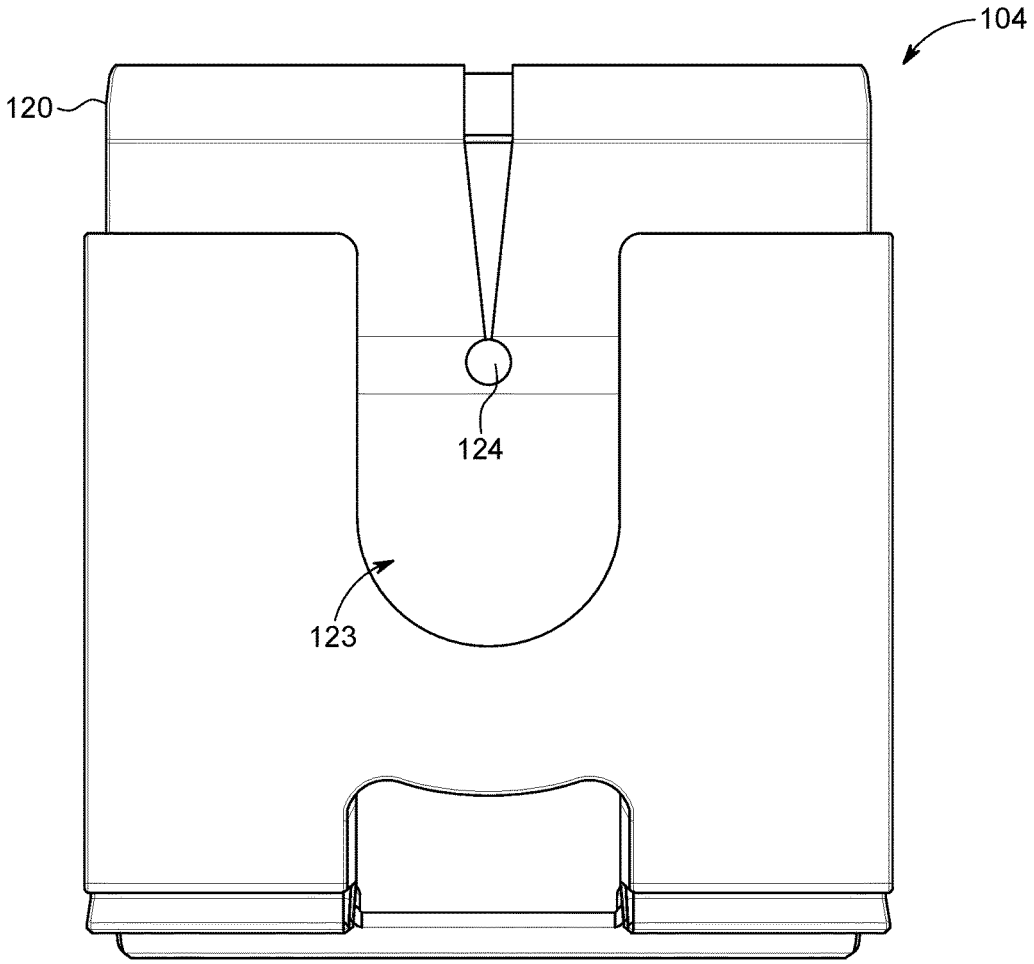
FIG. 3B is a front view of a female member of a swivel-lock quick release according to one embodiment of the present invention.

Referring to FIG. 3B, a front view of the female member 104 is illustrated. As shown, the slot 123 can have a generally "U" shape. As shown in FIG. 3B, the protrusion 124 can be located closer to a top of the channel 122.

Figure 3C:
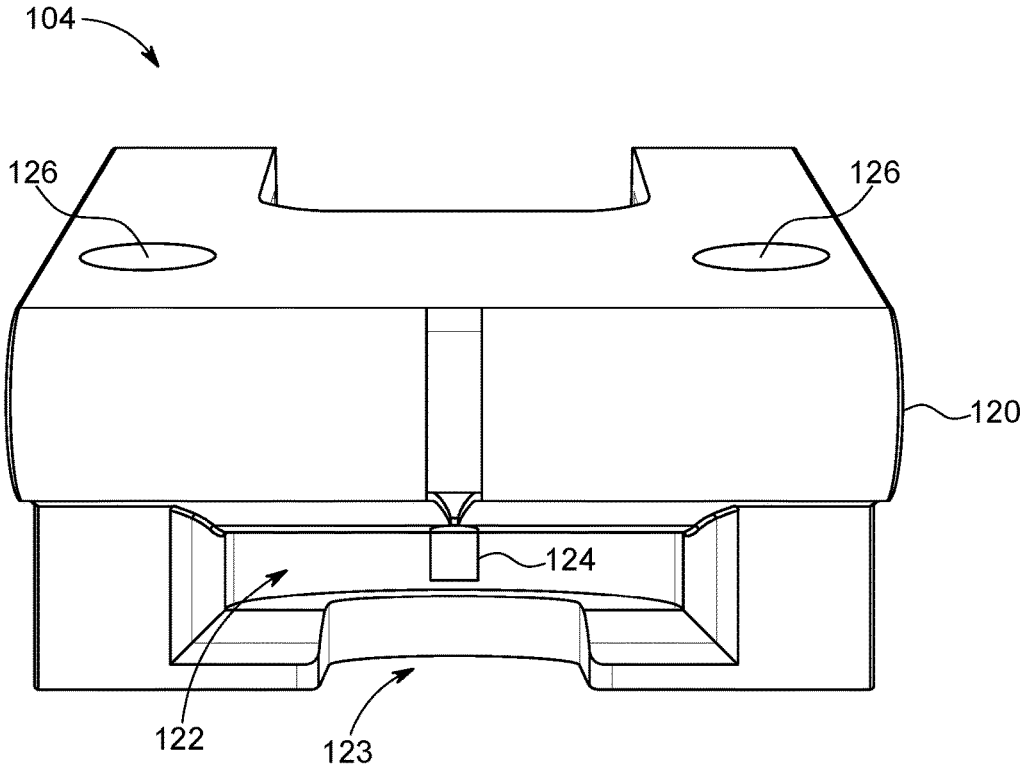
FIG. 3C is a top view of a female member of a swivel-lock quick release according to one embodiment of the present invention.

Referring to FIG. 3C, a top view of the female member 104 is illustrated. In one embodiment, the attachment mechanism 120 can include a pair of apertures 126 for receiving fasteners to more securely couple the female member 104 to a belt. As can be appreciated, fasteners can be passed through each of the apertures 126 and fasten directly to a belt.

Figure 3D:
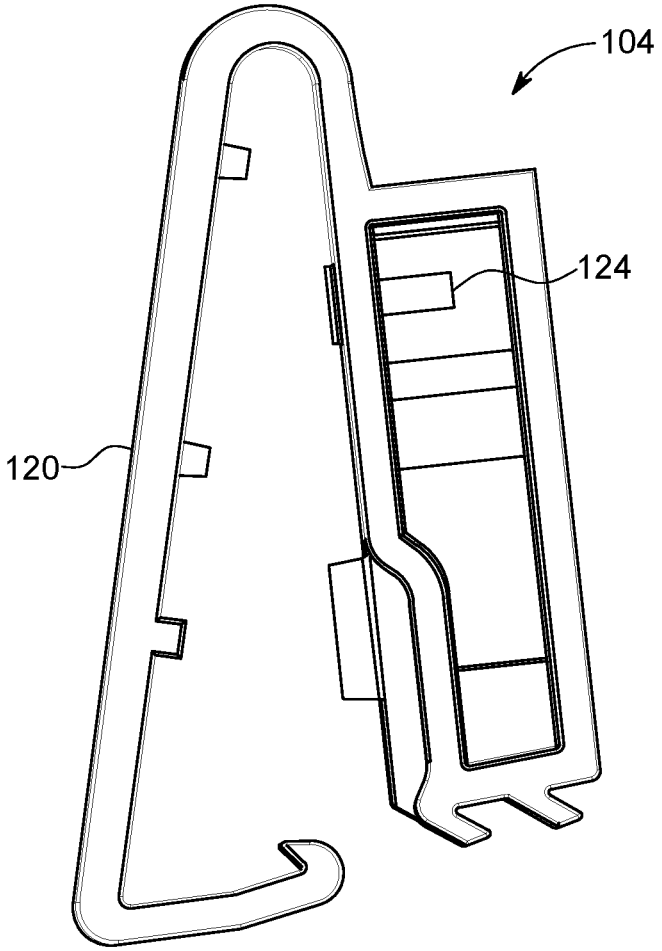
FIG. 3D is a side view of a female member of a swivel-lock quick release according to one embodiment of the present invention.

Referring to FIG. 3D, a side view of the female member 104 is illustrated. As shown, the attachment mechanism 120 can be a clip for securing to a belt. For instance, the clip 120 can be implemented to secure to a utility work belt of a worker. In another instance, the clip 120 can be implemented to couple to a bag having a strap. Of note, the clip is but one example of the attachment mechanism 120 and is not meant to be limiting.

Figure 3E:
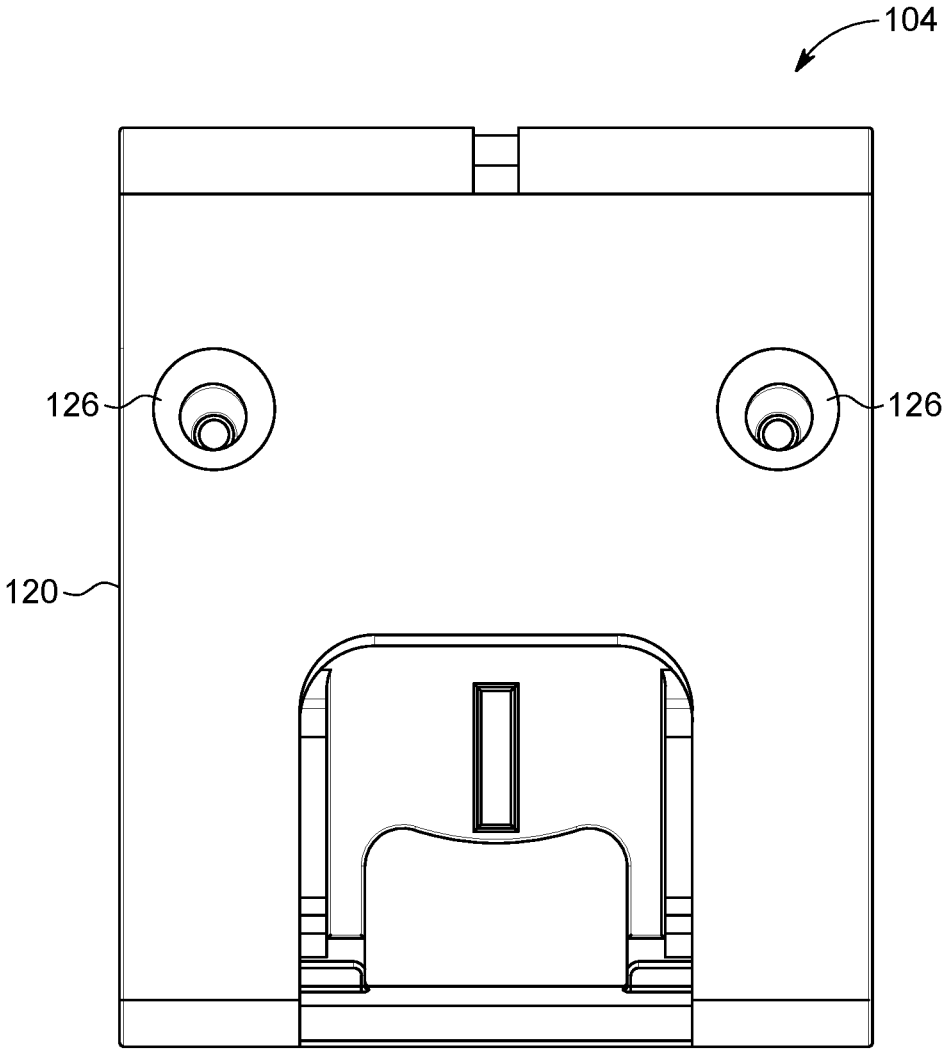
FIG. 3E is a back view of a female member of a swivel-lock quick release according to one embodiment of the present invention.

Referring to FIG. 3E, a back view of the female member 104 is illustrated. The apertures 126 are shown on the back side of the clip 120. Typically, a fastener can be passed through one or more of the apertures 126 and then through a belt inside the clip 120. Fasteners can be implemented to more securely couple the clip 120 to the belt or strap. In one instance, the belt can be passed through the opening of the clip 120. In another instance, the clip 120 can be opened from a bottom side and can be passed over a belt, for instance a belt being worn, and then the opening can be closed to secure the clip 120 to the belt.

Figure 4A:
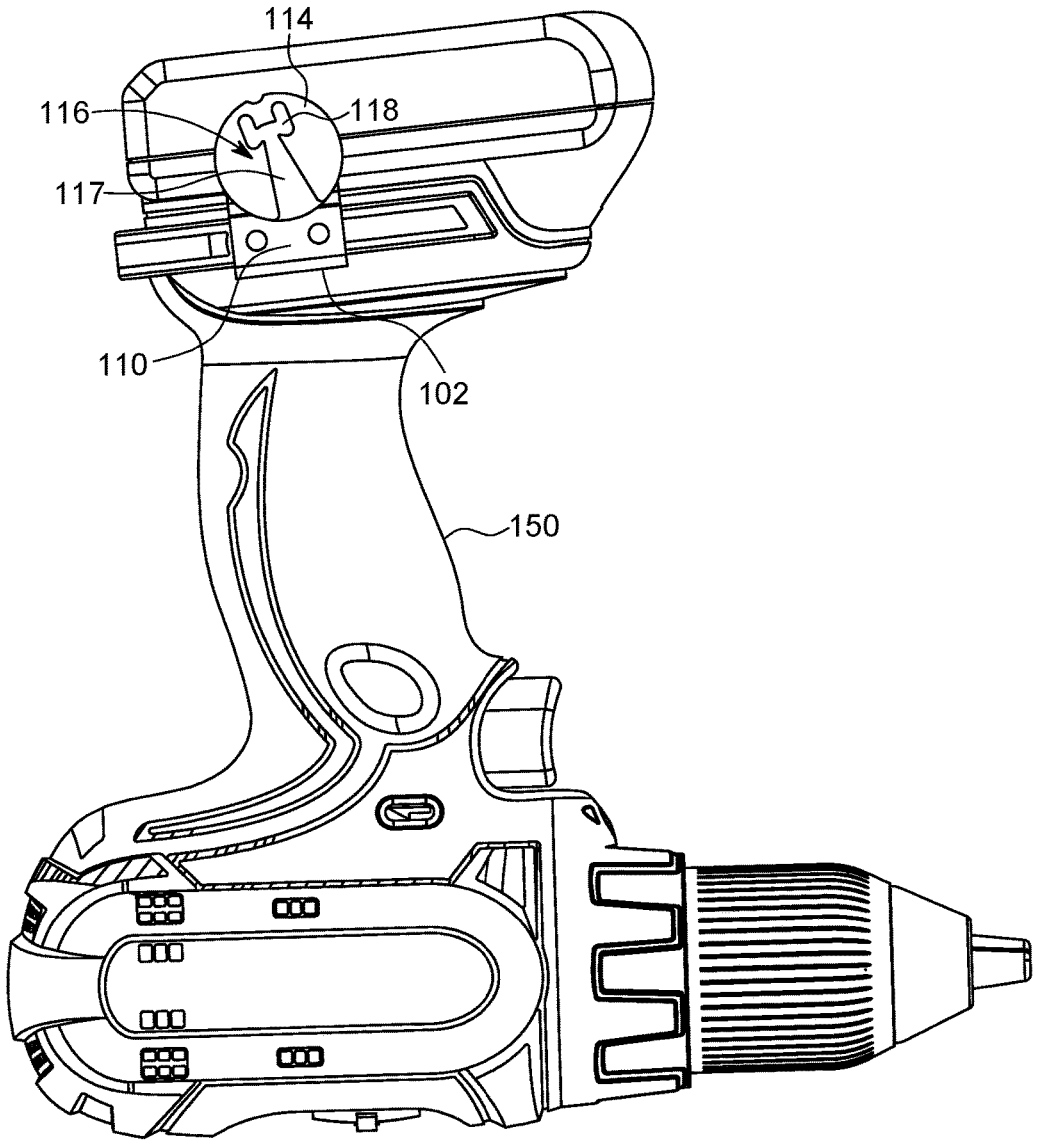
FIG. 4A is a side view a portion of a swivel-lock quick release coupled to a drill according to one embodiment of the present invention.
Figure 4B:
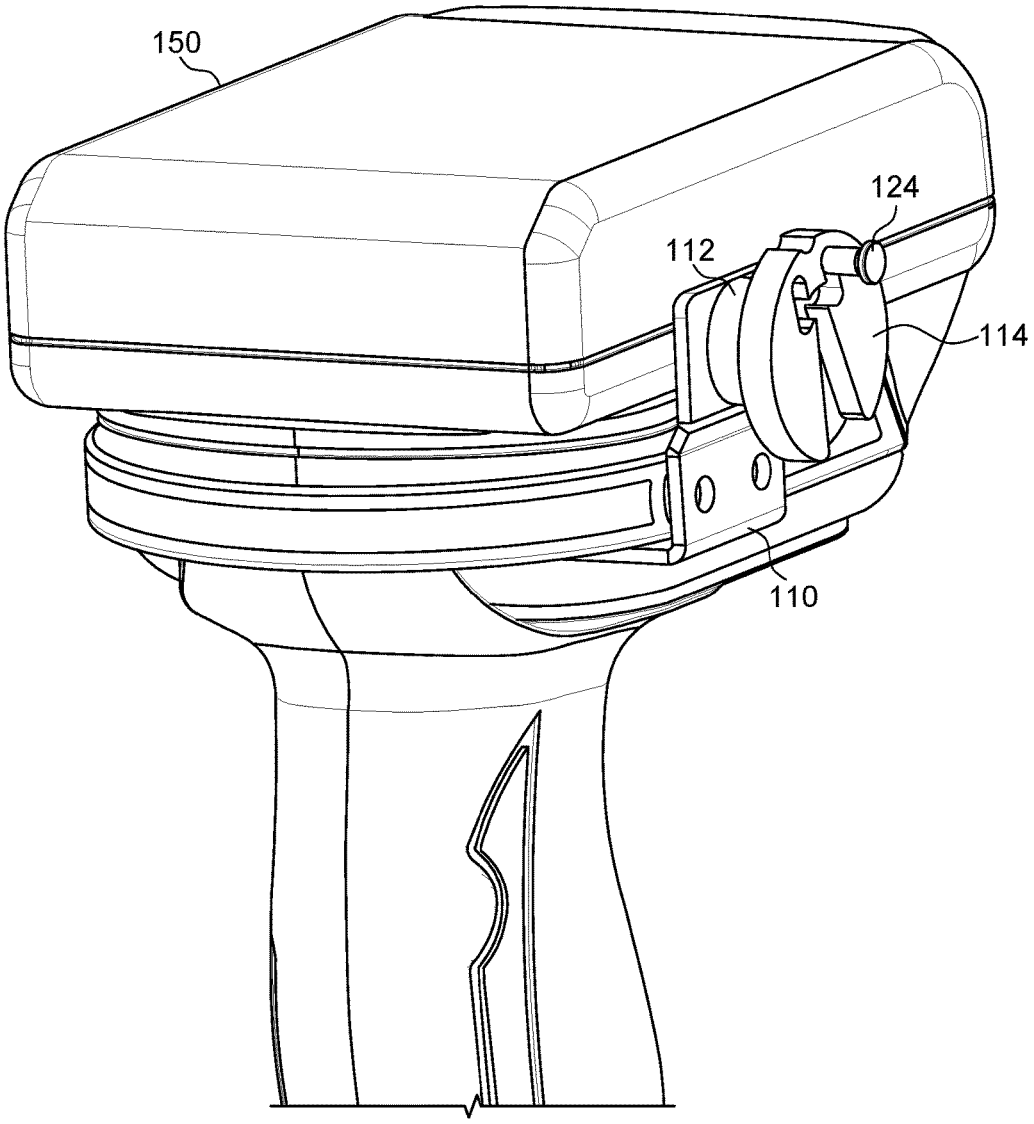
FIG. 4B is a back perspective view of a portion of a swivel-lock quick release coupled to a drill according to one embodiment of the present invention.

Referring to FIGS. 4A-4B, detailed diagrams of the male member 102 coupled to a drill 150 are illustrated. As shown in FIG. 4A, a side view of the drill 150 and the male member 102 is illustrated. As shown in FIG. 4B, a back perspective view of the drill 150 and the male member 102 is illustrated.

Depending on an object the swivel-lock quick release 100 may be coupled to, the engagement member 114 of the male member 102 can be configured to have the channel 116 slightly canted in either direction of a vertical axis of the object intersecting with a center of gravity of the object. For instance, as shown in FIG. 4A, the channel 116 of the engagement member 114 is canted to the left such that the locking section 118 of the channel 116 is in line with the vertical axis of the drill 150. As can be appreciated, when the male member 102 is inserted into the female member 104, the drill 150 would be off axis and wanting to rotate back towards the center of gravity. Once the protrusion 124 of the female member 104 gets to the top of the guide section 117, gravity would act upon the drill 150 and rotate the drill 150 back towards the center of gravity of the drill 150 moving the protrusion 124 of the female member 104 into the locking section 118. The drill 150 would then move down due to gravity thus moving the locking section 118 down until engaging the protrusion 124 of the female member 104. Of note, the previously mentioned actions may be initiated and completed by the user manually rotating the drill 150.

When the male member 102 is fully inserted into the female member 104, the protrusion 124 of the female member 104 can be located proximate a top of the locking section 118. As shown in FIG. 4B, the protrusion 124 has been moved to the top of the locking section 118. Though not shown, FIG. 4B represents the male member 102 being inserted into the female member 104 by illustrating the protrusion 124 proximate the top of the locking section 118.

It is to be appreciated that the size of the members 102, 104 can vary depending on the size, weight, and other considerations pertaining to the type of implement or tool the swivel-lock quick release is configured to hold. Further, the configuration of the attachment mechanisms of the male and female members 102,104 pertaining to the mounting of the respective members to a respective implement, harness, belt, or other substrate can vary significantly and substantially.

In one embodiment, the swivel-lock quick release 100 can be implemented as part of an assembly (or kit) that can be operated with a single hand to move from a locked position to an unlocked position and permit separation of operative components coupled to said swivel-lock quick release 100. The swivel-lock quick release assembly can include the male member 102 and the female member 104. The male member 102 can include a post 112 terminating in a circular flange 114 extending radially from the post 112. The female member 104 can include a channel 122 configured to receive the circular flange 114 therein. A face of the circular flange 114 can include a slot 116 formed thereon. The female member 104 can include a pin (or protrusion) 124. The pin 124 can be sized and configured to move in the slot 116 of the circular flange 114 between locked and unlocked positions.

To unlock or remove the male member 102 from the female member 104, a user can implement a two-step process. First, the user can lift the male member 102 vertically by applying an upward force on the male member 102. Next, while still applying the upward force to the male member 102, the user can rotate the male member 102 in a clockwise (or counterclockwise) direction and lift the male member 102 from the female member 104 to separate them. In one embodiment, the user may rotate the male member 102 approximately 30 degrees. In another embodiment, the user may rotate the male member 102 approximately 20 degrees. The amount of rotation to unlock the male member 102 can typically be between 10-35 degrees.

Typically, the slot 116 can comprise at least a vertically extending main slot 117 (trunk slot) and at least a vertically extending branch slot 118 extending from the left or right side of the main slot 117 and partially overlapping the main slot 117 proximate a distal end of the main slot 117. In one instance, the slot 116 can include two branch slots 118, 119, one on the left and one on the right. Generally, a top edge of the main slot 117 can be arcuate. By having an arcuate top edge, the pin 124 of the female member 104 can be directed towards either of the branch slots 118, 119 as the male member 102 is inserted into the female member 104. A top and a bottom end of the branch slot 118 (and 119) can be rounded. In one instance, a radius of the rounded end of the top side can be essentially ½ the width of the branch slot 118 (and 119) and the radius of the rounded end of the bottom side can be greater than ½ the width of the branch slot 118 (and 119). Typically, a width of the branch slot 118 can be slightly greater than the diameter of the pin 124. The main slot 117 can be tapered down from an opening of the main slot 117 towards the branch slots 118, 119.

Figure 5A:
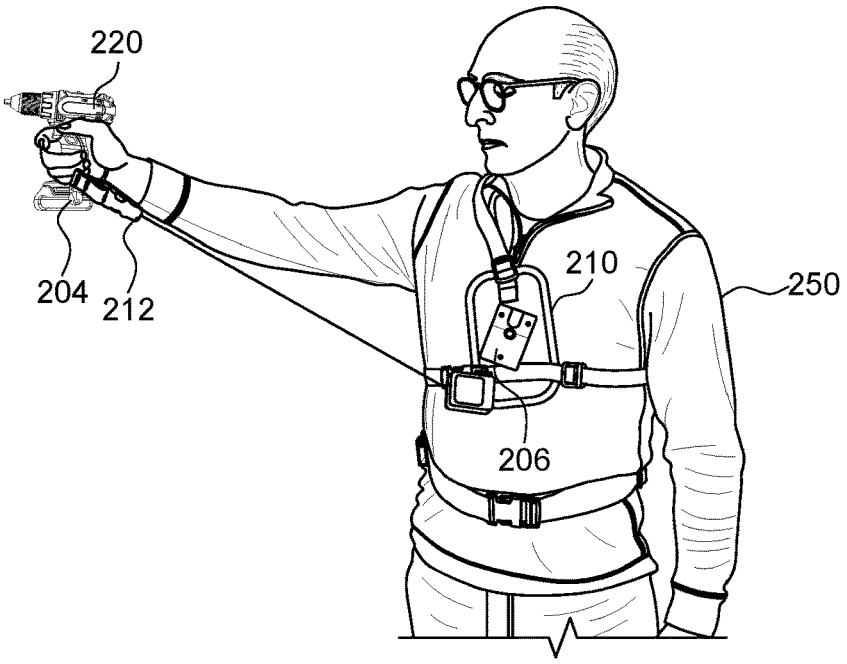
FIG. 5A is a front view of a swivel-lock quick release assembly in an unlocked position according to one embodiment of the present invention.
Figure 5B:
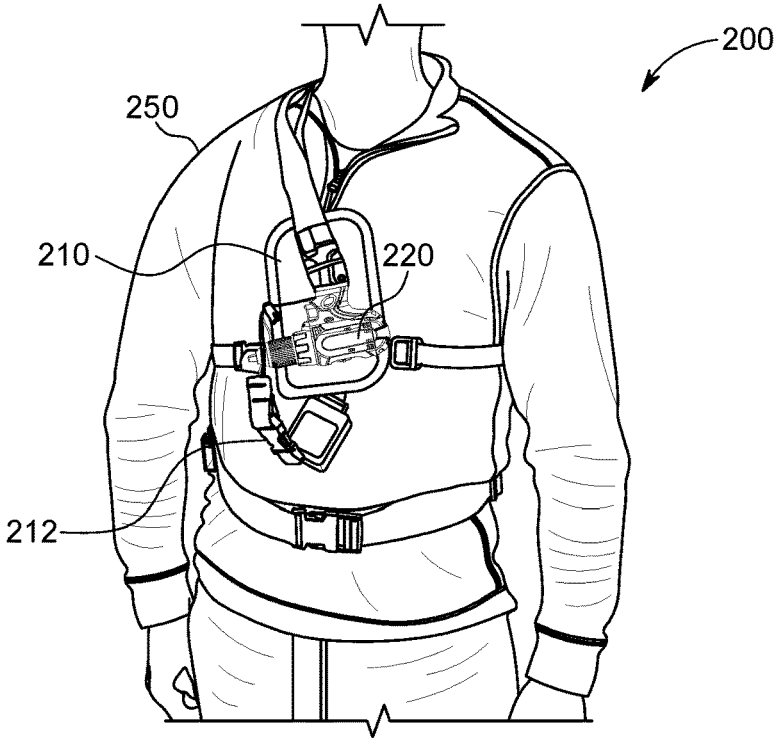
FIG. 5B is a front view of a swivel-lock quick release assembly in a locked position according to one embodiment of the present invention.

Referring to FIGS. 5A-5B, detailed diagrams of an embodiment 200 of a swivel-lock quick release system are illustrated. The system 200 can be implemented to couple an object to a chest harness worn by a user. As shown, the system 200 can be implemented to couple a drill (or driver) proximate a chest of the user. Referring to FIG. 5A, a detailed diagram of the swivel-lock quick release system 200 in an unlocked position is illustrated. Referring to FIG. 5B, a detailed diagram of the swivel-lock quick release system 200 in a locked position is illustrated.

Typically, the swivel-lock quick release system 200 can include, but is not limited to, a swivel-lock quick release and a chest harness 210. The swivel-lock quick release can be substantially similar to the previously described swivel-lock quick release 100. For instance, the swivel-lock quick release can include a male member 204 and a female member 206. As shown, the female member 206 can be coupled to the chest harness 210 and the male member 204 can be coupled to a drill 220.

As shown in FIG. 5A, the female member 206 can be located proximate a chest of a user 250 via the chest harness 210. The male member 204 can be coupled near a bottom portion of the drill 220 (or integrally formed therewith). In some embodiments, the harness 210 can include a tether 212 that can couple to the drill 220. The tether 212 can be implemented to ensure that the drill 220 does not fall from the user 250 in circumstances where the user drops the drill 220. As can be appreciated, if the user 250 were working at an elevated height, the tether 212 may prevent the drill 220 from falling down a long ways in an event where the user drops the drill 220.

When not in use, the user 250 can couple the drill 220 to the female member 206 on the chest harness 210. To couple the drill 220 to the chest harness 210, the user 250 can slide the engagement member of the male member 204 into the channel of the female member 206. As shown in FIG. 5B, the drill 220 can sit proximate the chest of the user 250 ready to be used when needed. To remove the drill 220, the user 250 can pull up on the drill 220 and then slightly rotate the drill 220 while maintaining an upward force on the drill 220 to remove the engagement member of the male member 204 from the channel of the female member 206.

As shown in FIG. 5B, the male member 204 and the female member 206 of the swivel-lock quick release can be interconnected in a locked position, with the male member 204 attached to the drill 220 and the female member attached to the harness 210. As a general rule, an opening of the channel of the female member 206 can be orientated in an upwardly facing position when the swivel-lock quick release is in use. In such a configuration, gravity acting on the male member 204 and the tool 220 attached thereto can pull the male member 204 into the channel of the female member 206.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A swivel-lock quick release comprising:

a male member, the male member defined by:

an attachment mechanism;

a first protrusion extending from the attachment mechanism; and a engagement member located on a distal end of the protrusion, wherein (i) a face of the engagement member includes a slot having a first section and a second section, (ii) each section includes a pair of sidewalls, and (iii) the second section of the slot is offset from the first section;

a female member adapted to receive to the male member, the female member defined by:

an attachment mechanism;

a channel sized to receive the engagement member of the male member; and a second protrusion extending into the channel, the protrusion configured to interface with the slot of the male member;

wherein the slot is canted off vertical at an acute angle.

2. The swivel-lock quick release of claim 1, wherein the first section of the slot is tapered down towards the second section.

3. The swivel-lock quick release of claim 1, wherein the second protrusion of the female member is adapted to pass through the first section of the slot as the male member is inserted into the channel of the female member.

4. The swivel-lock quick release of claim 1, wherein the attachment mechanism of the male member is removably coupled to the first protrusion.

5. The swivel-lock quick release of claim 1, wherein the attachment mechanism, the first protrusion, and the engagement member of the male member are integrally formed.

6. The swivel-lock quick release of claim 1, wherein the second section of the slot has a substantially stadium shape.

7. The swivel-lock quick release of claim 1, wherein the male member is removably coupled to a tool.

8. The swivel-lock quick release of claim 1, wherein the male member is integrally formed with a tool.

9. The swivel-lock quick release of claim 1, wherein the engagement member of the male member has a substantially disc shape.

10. The swivel-lock quick release of claim 1, wherein the first section of the slot includes an opening to allow the second protrusion of the female member to enter the slot of the male member.

11. The swivel-lock quick release of claim 1, wherein the female member further includes a substantially "U" shaped slot adapted to interface with the first protrusion of the male member.

12. A swivel-lock quick release assembly comprising:

a male member, the male member including a post terminating in a circular flange extending radially from the post; and a female member, the female member including a channel configured to receive the circular flange therein;

wherein a face of the circular flange includes a slot formed thereon and the female member further includes a pin being sized to move in the slot;

wherein the slot is defined by a first section being tapered towards a second section, the second section being offset from the first section.

13. The swivel-lock quick release assembly of claim 12, wherein (i) an end of the first section is arcuate, and (ii) a top end and a bottom end of the second section are rounded.

14. The swivel-lock quick release assembly of claim 13, wherein an effective radius of the bottom end of the second section is greater than a radius of the top end of the second section.

15. The swivel-lock quick release assembly of claim 14, wherein the radius of the top end of the second section is approximately ½ the width of a middle portion of the second section.

16. The swivel-lock quick release assembly of claim 12, wherein when the male member is inserted into the female member the pin of the female member is located proximate a top end of the second section.

17. A method of operating a swivel-lock quick release comprising:

providing a swivel-lock quick release, the swivel-lock quick release including:

a male member including a first protrusion and an engagement member located on a distal end of the first protrusion, a face of the engagement member including a slot; and a female member including a channel sized to receive the engagement member of the male member and a second protrusion extending into the channel, the second protrusion configured to interface with the slot of the male member;

coupling the male member to the female member;

removing the male member from the female member, the step of removing the male member including the following steps:

applying an upward force to the male member;

rotating the male member either in a clockwise or counterclockwise direction approximately 20 degrees while maintaining the upward force; and applying the upward force until the male member is removed from the female member.

18. The method of claim 17, further comprising the step of:

inserting the male member into the female member.

19. The method of claim 17, further comprising the steps of:

attaching the male member to a tool;

attaching the female member to an object; and mating the male member with the female member.

* * * * *